US007546824B2

(12) United States Patent
Ando

(10) Patent No.: US 7,546,824 B2
(45) Date of Patent: Jun. 16, 2009

(54) VARIABLE VALVE TIMING MECHANISM-EQUIPPED ENGINE

(75) Inventor: Satoshi Ando, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 12/041,728

(22) Filed: Mar. 4, 2008

(65) Prior Publication Data

US 2008/0216783 A1 Sep. 11, 2008

(30) Foreign Application Priority Data

Mar. 8, 2007 (JP) ..... 2007-058035

(51) Int. Cl.
*F01L 1/02* (2006.01)

(52) U.S. Cl. ..... 123/90.31; 123/90.12; 123/198 E

(58) Field of Classification Search ..... 123/90.12, 123/90.13, 90.15, 90.16, 90.17, 90.18, 90.27, 123/90.31, 193.3, 193.5, 195 C, 198 E, 198 F
See application file for complete search history.

(56) References Cited

U.S. PATENT DOCUMENTS 6,182,624 B1 2/2001 Ozeki

FOREIGN PATENT DOCUMENTS

JP 2000-199409 7/2000
JP 2001-355415 12/2001

*Primary Examiner*—Ching Chang
(74) *Attorney, Agent, or Firm*—Hirsch Simpson LLC

(57) ABSTRACT

A variable valve timing mechanism-equipped engine is provided which allows a mount installing section and a hydraulic control valve of a variable valve timing mechanism to be positioned in a chain case without limitation of positioning of accessories such as a water pump, air conditioning compressor, power steering oil pump and alternator, and which simplifies an operating oil passage for the hydraulic control valve. In the variable valve timing mechanism-equipped engine, a mount installing section is positioned below an actuator cover section and is offset toward one side with respect to a cylinder axis, and intake- and exhaust-side hydraulic control valves are disposed sideward of the mount installing section with axes inclined toward a direction perpendicular to the crankshaft axis, the intake- and the exhaust-side hydraulic control valves overlapping one another.

3 Claims, 5 Drawing Sheets

VARIABLE VALVE TIMING MECHANISM-EQUIPPED ENGINE

FIELD OF THE INVENTION

The present invention relates to a variable valve timing mechanism-equipped engine, and more particularly to a variable valve timing mechanism-equipped engine which allows a mount installing section and a hydraulic control valve of a variable valve timing mechanism to be positioned in a chain case without limitation of positioning of accessories, and which simplifies an operating oil passage for the hydraulic control valve.

BACKGROUND OF THE INVENTION

An engine mounted on a vehicle, etc. may include a variable valve timing mechanism for changing the rotational phase of a camshaft with respect to a crankshaft, in which an actuator is attached to the camshaft and is operated by the operating oil supplied from a hydraulic control valve.

JP 2000-199409A [Patent Document 1] teaches variable valve timing mechanism-equipped engines in which the hydraulic control valve is attached to a chain case covering a timing chain for supplying the oil pressure for operating the actuator. Such a variable valve timing mechanism-equipped engine is provided, in the chain case, with an actuator cover section covering the actuator, with a mount installing section for attaching an engine mount, and with the hydraulic control valve below the actuator cover section and the mount installing section. The hydraulic control valve is downwardly and sidewardly covered by a crankshaft pulley and an accessory that is driven by the crankshaft pulley.

In addition, JP 2001-355415A [Patent Document 2] teaches a variable valve timing mechanism-equipped engine, wherein intake-side and exhaust-side actuators of the variable valve timing mechanism are attached to respective intake and exhaust camshafts; intake- and exhaust-side hydraulic control valves are attached to a cylinder head for supplying the operating oil to the intake- and the exhaust-side actuators. In the variable valve timing mechanism-equipped engine, the intake- and the exhaust-side hydraulic control valves are disposed with axes inclined outwardly of the cylinder head in the vicinity of extremities of the intake and the exhaust camshafts.

Problems to be Solved by the Invention

According to the variable valve timing mechanism-equipped engine disclosed in JP2001-355415A, the intake- and the exhaust-side actuators of the variable valve timing mechanism are attached respectively to the intake and the exhaust camshafts; two intake- and exhaust-side hydraulic control valves are attached to the cylinder head for supplying the operating oil to the intake- and the exhaust-side actuators, which complicates the structure of the cylinder head.

To address the problem, attachment of two hydraulic control valves to the chain case can simplify the structure of the cylinder head; however, the installation positions of the two hydraulic control valves are lowered due to the actuator cover section and the mount installing section, contracting the space below the hydraulic control valve and causing the problem of placing the belt for driving the accessory.

Also, when the two hydraulic control valves are respectively disposed at positions opposing to the cylinder block and the cylinder head, operating oil passages for the hydraulic control valves must be disposed both in the cylinder head and the cylinder block, complicating the structure of the operating oil passage.

SUMMARY OF THE INVENTION

An object of the present invention is to provide a variable valve timing mechanism-equipped engine having two hydraulic control valves, in which a mount installing section and a hydraulic control valve can be positioned in a chain case without limiting the positioning of accessories and in which the operating oil passage for the hydraulic control valve can be simplified.

The present invention provides a variable valve timing mechanism-equipped engine, having

- a crankshaft rotatably supported in a cylinder block of the engine,
- a pair of intake and exhaust camshafts rotatably supported on a cylinder head mounted on the upperside of the cylinder block,
- a timing chain entrained around a crankshaft sprocket and intake and exhaust camshaft sprockets, the crankshaft sprocket being attached to the crankshaft, the intake and the exhaust camshaft sprockets being attached to the intake and the exhaust camshafts,
- intake- and exhaust-side actuators attached to the intake and the exhaust camshafts for changing the rotational phase of the intake and the exhaust camshafts with respect to the crankshaft, the intake and the exhaust-side actuators being operated by the operating oil supplied from intake- and exhaust-side hydraulic control valves respectively,
- a chain case, when viewing the engine from an axial direction of the crankshaft, having transverse opposite ends joined to the cylinder block and the cylinder head and having an upper end joined to the cylinder head cover for covering the timing chain,
- an actuator cover section formed in the chain case to be expanded in the axial direction of the crankshaft along a mating surface with the cylinder head cover for covering the intake- and the exhaust-side actuators,
- a mount installing section expanded in the axial direction of the crankshaft to be disposed below the actuator cover section for connecting an engine mount, and
- accessories arranged on transverse opposite sides of the chain case to overlap along a cylinder axis direction, the accessories being driven through a belt on a crankshaft pulley attached to the crankshaft, characterized in that
- the mount installing section is positioned below the actuator cover section and is offset toward one side with respect to the cylinder axis, and
- the intake- and the exhaust-side hydraulic control valves are disposed sideward of the mount installing section with axes inclined toward a direction perpendicular to the crankshaft axis, the intake- and the exhaust-side hydraulic control valves overlapping one another.

According to an embodiment of the variable valve timing mechanism-equipped engine according to the invention, the intake-side and the exhaust-side hydraulic control valves are inclined such that their axes become more distant from the crankshaft axis when departing from the cylinder axis, and are disposed on the chain case opposing to the cylinder head.

According to another embodiment of the variable valve timing mechanism-equipped engine according to the invention, the hydraulic control valve which is the upper one of the intake-side and the exhaust-side hydraulic control valves in the direction of the cylinder axis C2, is offset outwardly in the direction of the axes of the hydraulic control valves with respect to the lower hydraulic control valve, and further an operating oil passage, communicating between the lower one of the hydraulic control valves and the actuator, is disposed sideward of the upper hydraulic control valve.

Effects of the Invention

According to the present invention, the mount installing section is positioned below the actuator cover section and is offset toward one side with respect to the cylinder axis, and the intake- and the exhaust-side hydraulic control valves are disposed sideward of the mount installing section with axes inclined toward the direction perpendicular to the crankshaft axis, the intake- and the exhaust-side hydraulic control valves overlapping one another. Therefore, the mount installing section and the two valves, i.e. the intake- and the exhaust-side hydraulic control valves, are disposed in intimate contact with the actuator cover section to expand the space below the intake- and the exhaust-side hydraulic control valves.

Consequently, the variable valve timing mechanism-equipped engine of the present invention permits two pulleys, an idler pulley and a tensioner pulley, to be positioned in the space below the intake- and the exhaust-side hydraulic control valves, so that more than one accessory, which are positioned on the transverse opposite sides of the chain case, can be driven by a single belt. Also, the variable valve timing mechanism-equipped engine of the present invention permits the tensioner pulley, which is at a lower position in the cylinder axis direction, to be positioned adjacent to the crankshaft pulley toward a loosening side of the belt with respect to the crankshaft pulley; an alternator and an air conditioning compressor, which are heavy among the plural accessories, can be positioned at a lower position and sideward of the crankshaft pulley to lower the center of gravity of the engine. Therefore, the variable valve timing mechanism-equipped engine of the present invention reduces the force transmitted to the engine mount to effectively limit the movement of the upper part of the engine to prevent contact of the components disposed in the upper part of the engine with an engine hood.

By the above-mentioned structure of the variable valve mechanism-equipped engine of the present invention, the mount installing section and the intake- and the exhaust-side hydraulic control valves can be positioned in the space surrounded by the actuator cover section, the crankshaft pulley, and the accessories without limiting the mounting position of the accessories.

BEST MODE FOR CARRYING OUT THE INVENTION

According to the present invention, the mount installing section is positioned below the actuator cover section and is offset toward one side with respect to the cylinder axis, and the intake- and the exhaust-side hydraulic control valves are disposed sideward of the mount installing section with axes inclined toward the direction perpendicular to the crankshaft axis, the intake- and the exhaust-side hydraulic control valves overlapping one another. This expands the space below the intake- and the exhaust-side hydraulic control valves. In this space, the two pulleys, an idler pulley and a tensioner pulley, can be positioned, so that more than one accessory, which are positioned on the transverse opposite sides of the chain case, can be driven by a single belt.

Embodiments of the present inventions are explained in detail in the following description with reference to FIGS. 1-7 which illustrate the present invention.

DETAILED DESCRIPTION OF AN EMBODIMENT OF THE INVENTION

Figure 6:
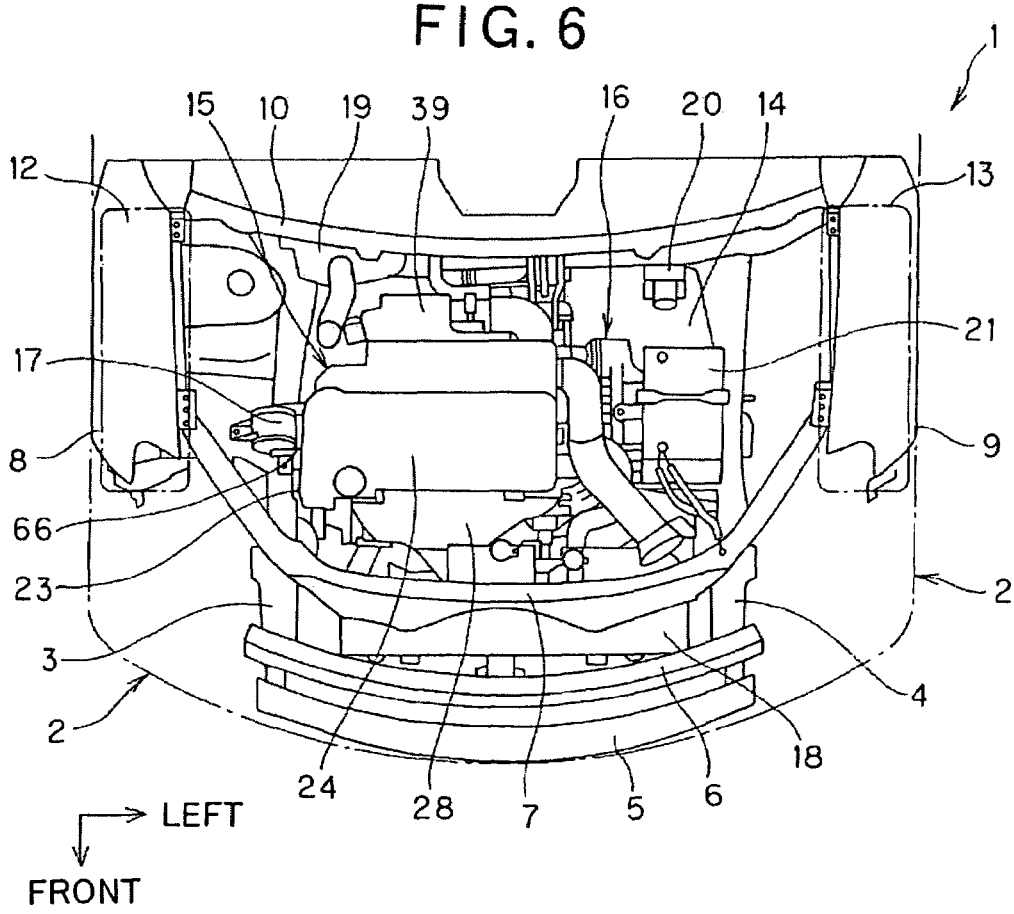
FIG. 6 is a plan view of an engine space of a vehicle according to an embodiment of the present invention.
Figure 7:
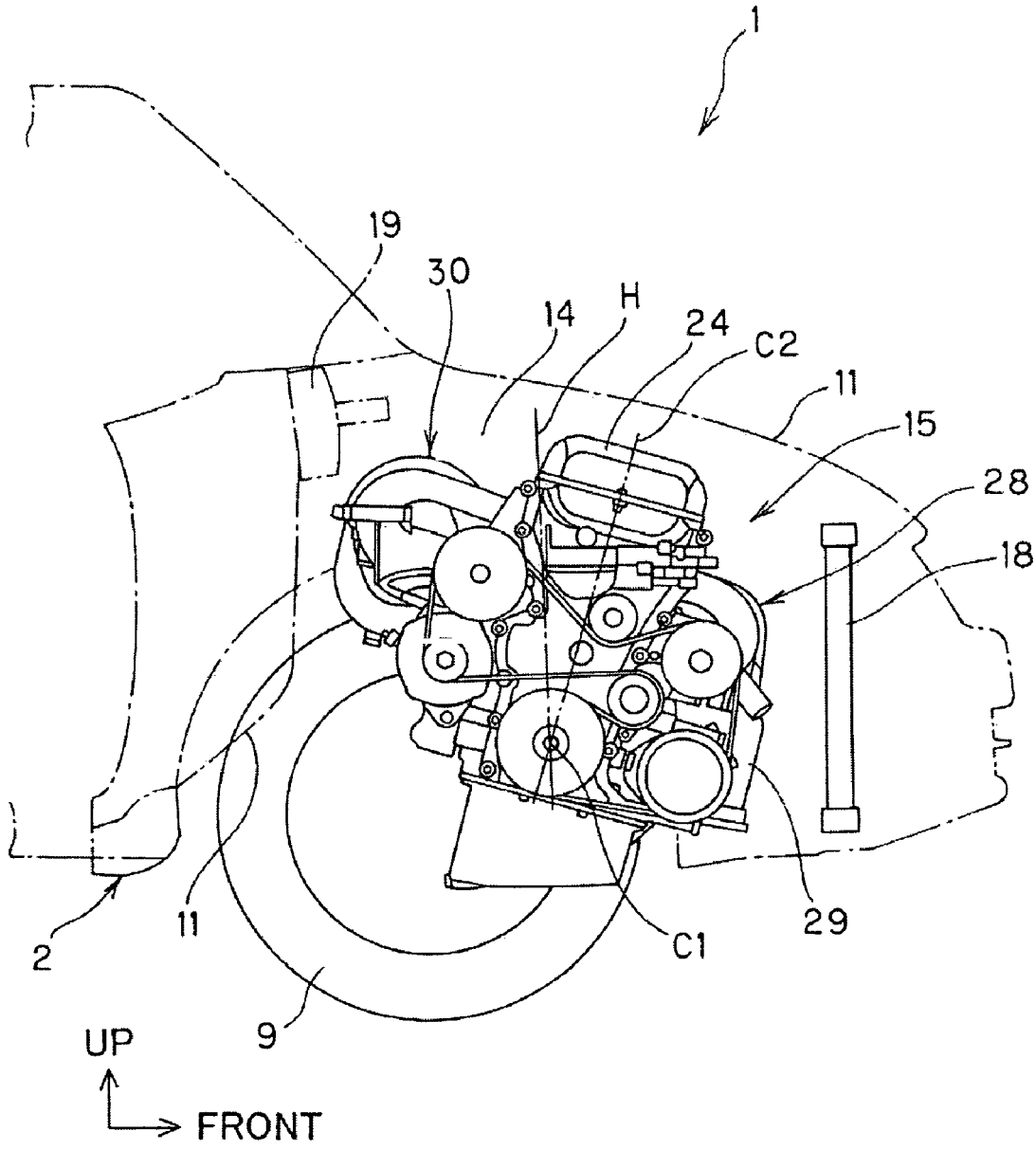
FIG. 7 is a right side view of an engine space of a vehicle according to an embodiment of the present invention.

In FIGS. 6 and 7, a vehicle 1, a vehicle body 2, a right side frame 3, a left side frame 4, a front bumper member 5, a front cross member 6, a front upper member 7, a right fender 8, a left fender 9, a dash panel 10, an engine hood 11, a right front vehicle wheel 12, and a left front vehicle wheel 13 are illustrated. The vehicle 1 is separated by the dash panel 10 extending transversely of the vehicle body 2, and defines an engine space or room 14, forward of the dash panel 10, surrounded by the front cross member 6, the front upper member 7, the right fender 8, the left fender 9, and the engine hood 11.

In the engine space 14, a variable valve timing mechanism-equipped engine 15 and a transmission 16 are arranged transversely of the vehicle 1. The variable valve timing mechanism-equipped engine 15 (hereinafter referred to as "engine") 15 is supported by a right engine mount 17, a left engine mount, a front engine mount, and a rear engine mount, and has a cylinder axis C2 inclined forwardly with respect to a vertical line H. The engine 15 is mounted toward a right side of the engine space 14. The transmission 16 is connected to a left side of the engine 15, and is mounted toward a left side of the engine space 14.

In the engine space 14, a radiator 18, elongated transversely of the vehicle 2, is attached to the front cross member 6 and the front upper member 7, which are forward of the engine 15 and the transmission 16. In the engine space 14, a master back 19 of braking and an ABS (anti-lock brake system) unit 20 are attached to the dash panel 10 rearward of the engine 15 and the transmission 16. Also, in the engine space 14, a battery 21 is mounted on the left side frame 4 leftwardly and upwardly of the transmission 16.

Figure 3:
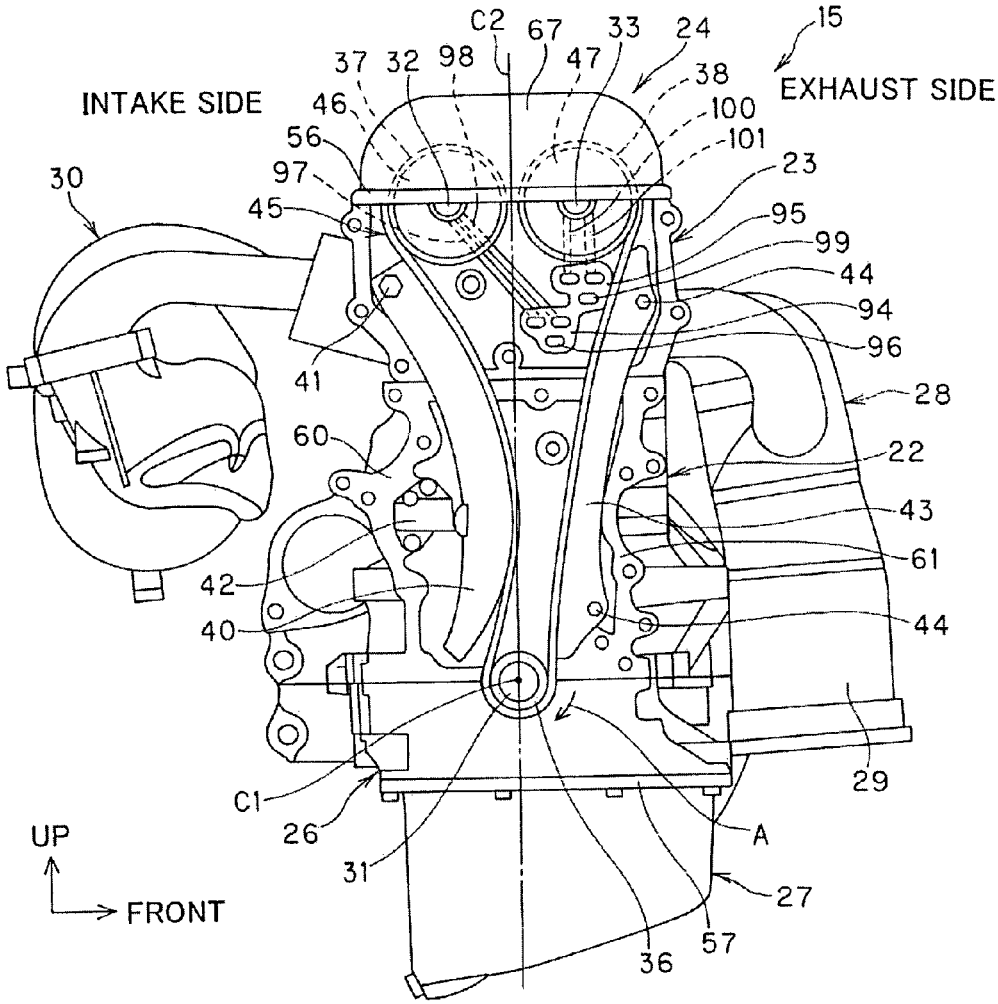
FIG. 3 is a right side view of a variable valve timing mechanism-equipped engine according to an embodiment of the present invention, without a chain case.

Referring to FIG. 3, the engine 15 includes: a cylinder head 23 mounted on top of a cylinder block 22; a cylinder head cover 24 attached to the cylinder head 23; a crankcase 26 attached to a lower part of the cylinder block 22; and an oil pan 27 attached to a lower part of the crankcase 26. Referring to FIGS. 6 and 7, the engine 15 includes an exhaust manifold 28 forward of the cylinder head 23 opposing to the radiator 18, and a catalytic converter 29 connected to the exhaust manifold 28. An exhaust pipe, extending toward the rear of the vehicle body 2, is connected to the catalytic converter 29. Also, the engine 15 includes an intake manifold 30 rearward of the cylinder head 23 opposing to the dash panel 10.

Figure 4:
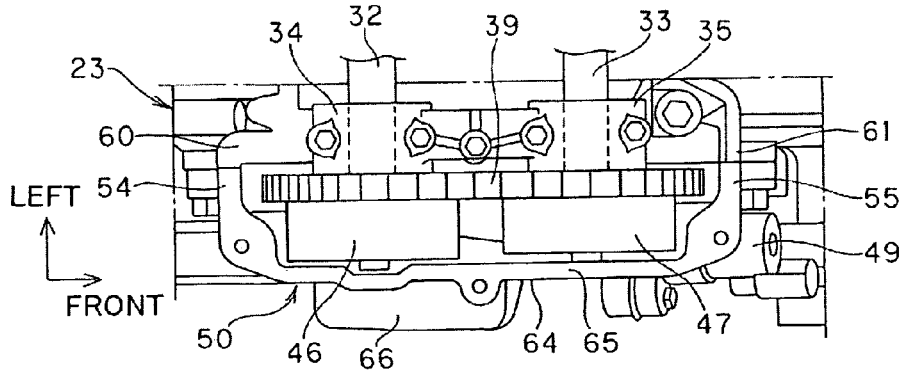
FIG. 4 is a main plan view of a variable valve timing mechanism-equipped engine according to an embodiment of the present invention, without a cylinder head cover.

Referring to FIG. 3, the engine 15 includes a crankshaft 31 rotatably supported by a crankcase 26 in a lower part of the cylinder block 22; referring to FIG. 4, in the cylinder head 23 mounted on the cylinder block 22, a pair of intake and exhaust camshafts 32 and 33 are rotatably supported by intake and exhaust camshaft caps 34 and 35. The engine 15 includes a timing chain 39 entrained around or between a crankshaft sprocket 36 and intake and exhaust camshaft sprockets 37 and 38, which camshaft sprocket 36 is attached to an end of the crankshaft 31, which camshaft sprockets 37 and 38 are attached to ends of the intake and the exhaust camshafts 32 and 33.

The timing chain 39 transmits the rotation of the crankshaft 31 (rotation in a direction indicated by an arrow A in FIG. 3) through the crankshaft sprocket 36 and the intake and the exhaust camshaft sprockets 37 and 38 to the intake and the exhaust camshafts 32 and 33, rotating the intake and the exhaust camshafts 32 and 33 in synchronism with the rotation of the crankshaft 31.

The timing chain 39 includes a chain tension lever 40 on a loosening side with respect to a rotational direction of the crankshaft 31 (on the left side of FIG. 3). The chain tension lever 40 is supported at an upper end thereof by a mounting bolt 41 on an edge surface of the cylinder head 23 to pivot or swing at a lower end thereof along an end surface of the cylinder block 22. The chain tension lever 40 is pushed toward an exhaust side, right side of FIG. 3, by a chain tension adjuster 42 attached to the end surface of the cylinder block 22 to press the timing chain 39 to provide appropriate tension. Also, the timing chain 39 includes a chain guide 43 on a tensioning side with respect to the rotational direction of the crankshaft 31 (on the right side of FIG. 3). The chain guide 43 is attached to the cylinder block 22 and the cylinder head 23 by a mounting bolt 44 to support the rotating timing chain 39 for restraining its swing.

Figure 1:
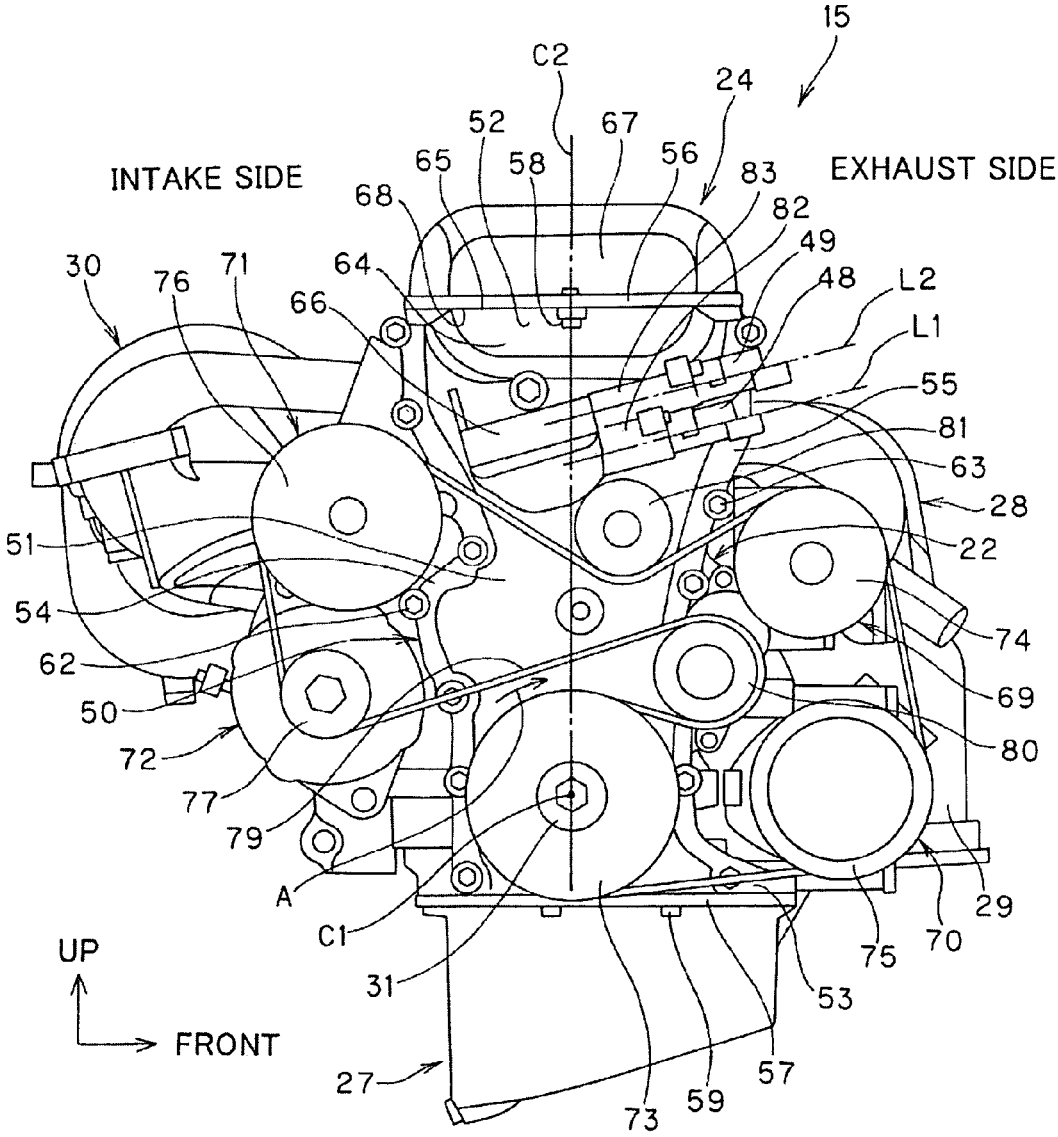
FIG. 1 is a right side view of a variable valve timing mechanism-equipped engine according to an embodiment of the present invention.

Referring to FIG. 3, the engine 15 includes a variable valve timing mechanism 45. The variable valve timing mechanism 45 includes respectively intake- and exhaust-side actuators 46 and 47 attached to the intake and the exhaust camshaft sprockets 37 and 38 at ends of the intake and the exhaust camshaft 32 and 33. As shown in FIG. 1, the variable valve timing mechanism 45 further includes respectively intake- and exhaust-side hydraulic control valves 48 and 49 attached to intake- and exhaust-side hydraulic control valve installing sections 82 and 83 for supplying the operating oil to the intake- and the exhaust-side actuators 46 and 47. The intake- and the exhaust-side actuators 46 and 47 are operated by the operating oil supplied by the intake- and the exhaust-side hydraulic control valves 48 and 49, and change the rotational phase of the intake and the exhaust camshafts 32 and 33 with respect to the crankshaft 32.

Referring to FIG. 1, the engine 15 includes a chain case 50 which has transverse opposite ends, when viewing the engine 15 in the crankshaft direction C1, joined to the cylinder block 22 and the cylinder head 23 and which has an upper end joined to the cylinder head cover 24 to cover the timing chain 39. The chain case 50 is provided with upper and lower attaching flanges 52 and 53 respectively attached to upper and lower vertical ends of a flat plate section 51, and with intake- and exhaust-side attaching flanges 54 and 55 respectively attached to opposite transverse sides of the flat plate section 51. In the chain case 50, the upper attaching flange 52 is attached to a cover-side joining section 56 of the cylinder head cover 24 by a mounting bolt 58, and the lower attaching flange 53 is attached to an oil pan-side joining section 57 of the oil pan 27 by a mounting bolt 59. Also, the intake- and the exhaust-side attaching flanges 54 and 55 are attached respectively to intake- and exhaust-side installing sections 60 and 61 (see FIG. 3) on transverse opposite sides of the cylinder head 23 and the crankcase 26 by fixing bolts 62 and 63.

Figure 5:
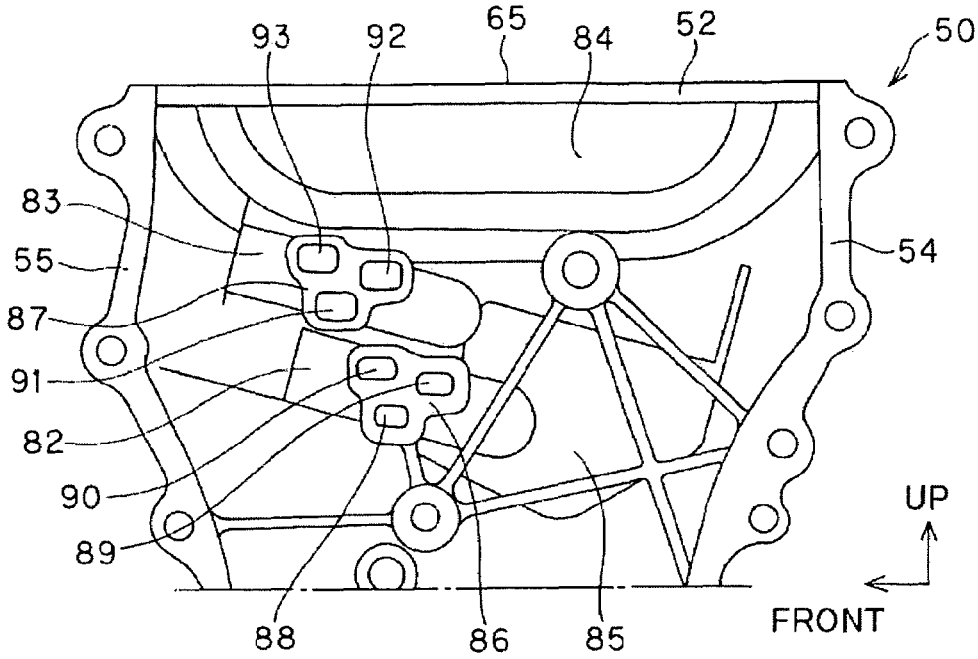
FIG. 5 is a main side view of inside of a chain case according to an embodiment of the present invention.

Referring to FIGS. 4 and 5, in the chain case 50, an actuator cover section 64, covering the intake- and the exhaust-side actuators 46 and 47, is formed to protrude in a direction of the crankshaft C1 along a joining (mating) surface 65 (see FIG. 1) with the cylinder head cover 24; a mount installing section 66 is formed under the actuator cover section 64 to protrude in the direction of the crankshaft C1, the right engine mount 17 being connected thereto. The actuator cover section 64 is formed by expanding the flat plate section 51 in a direction departing from the cylinder head 23, which flat plate section 51 is adjacent to the upper attaching flange 52 forming the joining surface 65 with the cylinder head cover 24.

Referring to FIG. 1, the cylinder head cover 24 includes an actuator cover section 67 protruding in the direction of the crankshaft C1 along the joining surface 68 with the chain case 50 for covering the intake- and the exhaust-side actuators 46 and 47. The actuator cover section 67 of the chain over 24 covers upper parts of the intake- and the exhaust-side actuators 46 and 47 and is joined to the actuator cover section 64 of the chain case 50 covering the lower parts of the intake- and the exhaust-side actuators 46 and 47.

The engine 15 includes, as a plurality of accessories on transverse opposite sides of the chain case 50, a water pump 69, an air conditioning compressor 70, a power steering oil pump 71, and an alternator 72. The water pump 69 and the air conditioning compressor 70 are arranged to vertically overlap one another on one transverse side centering the cylinder axis C2 of the cylinder block 22 (exhaust side). The power steering oil pump 71 and the alternator 72 are arranged to vertically overlap one another on the other transverse side centering the cylinder axis C2 of the cylinder block 22 (intake side).

The engine 15 includes a belt 79 for driving the accessories entrained around the crankshaft pulley 73 at one end of the crankshaft 31 protruding from the chain case 50, the air conditioning compressor pulley 75 for the air conditioning compressor 70, the power steering oil pump pulley 76 for the power steering oil pump 71, and the alternator pulley 77 for the alternator 72. The belt 79 transmits the rotation of the crankshaft 31 (the rotation indicated by an arrow A in FIG. 1) through the pulleys 73-77 to the water pump 69, the air conditioning compressor 70, the power steering oil pump 71, and the alternator 72 to rotate the accessories 69-72.

The belt 79 is associated with a tensioner pulley 80 on a loosening side (left side of FIG. 3) with respect to the rotation of the crankshaft 31, and with an idler pulley 81. The tensioner pulley 80 is disposed in a space surrounded by the pulleys 73-77 and on transverse one side of the cylinder block 22 (exhaust side), and is pushed to the right in FIG. 1 by a tensioner to provide appropriate tension to the belt 79. The idler pulley 81 is disposed on the flat plate section 51 of the chain case 50 in a space surrounded by the water pump pulley 74 and the power steering oil pump pulley 76 and below the mount installing section 66 to maintain the operating belt 79 to restrain its swinging.

The engine 15 thus includes the accessories, i.e. the water pump 69, the air conditioning compressor 70, the power steering oil pump 71, and the alternator 72, which are driven through the belt 79 by the crankshaft pulley 73 attached to the crankshaft 31; the plural accessories are disposed on transverse opposite sides of the chain case 50 while overlapping on another in the cylinder axis direction C2.

Figure 2:
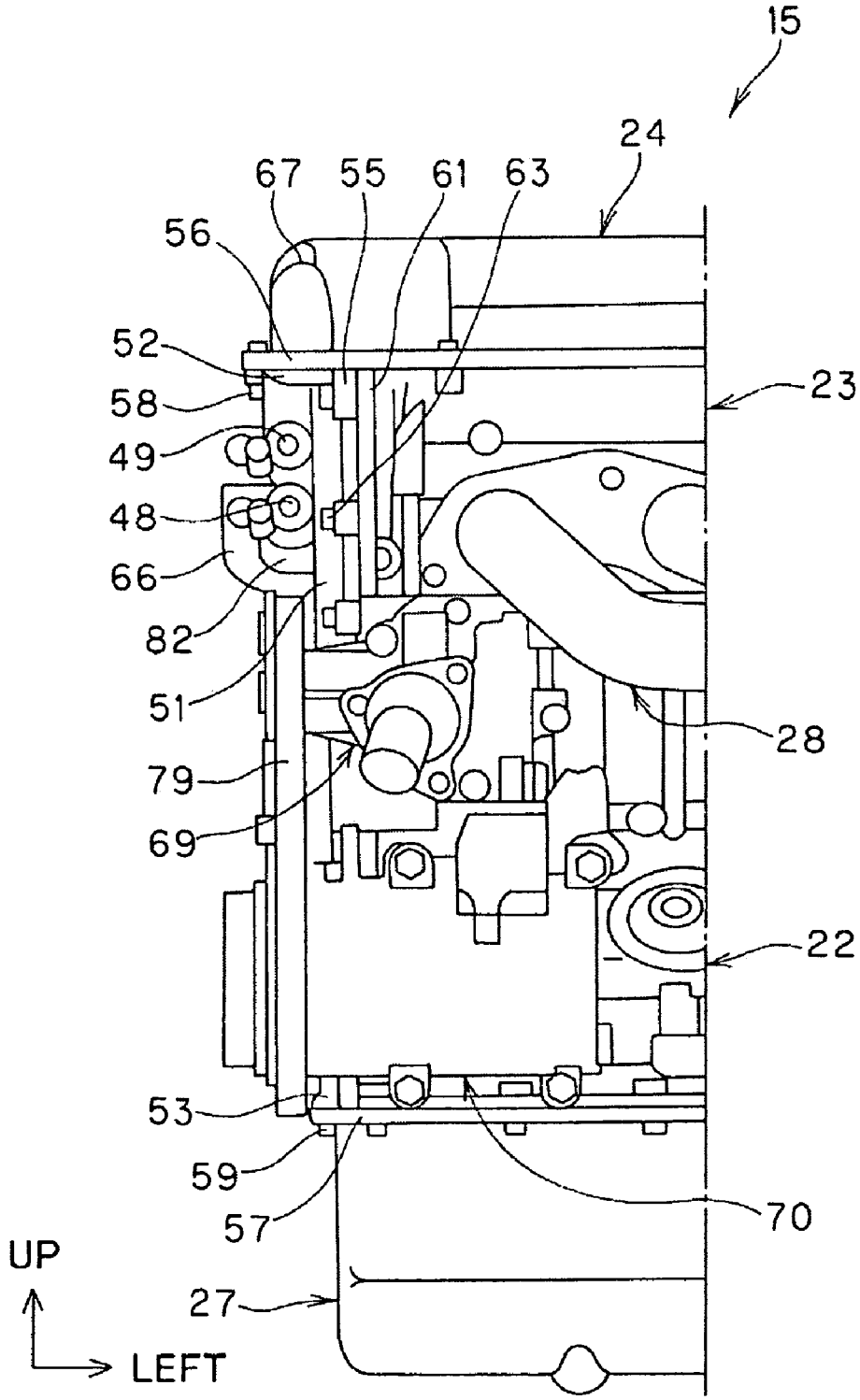
FIG. 2 is a main front view of a variable valve timing mechanism-equipped engine according to an embodiment of the present invention.

Referring to FIGS. 1 and 2, in the engine 15, the mount installing section 66 is formed to protrude at the flat plate section 51 offset toward one side with respect to the cylinder axis C2 below the actuator cover section 64 of the chain case 50; intake -and exhaust-side hydraulic control valve installing sections 82 and 83 are formed to protrude at the flat plate section 51 positioned on the other side with respect to the cylinder axis C2 opposing to the mount installing section 66 for attaching the intake- and the exhaust-side hydraulic control valves 48 and 49. The intake- and exhaust-side hydraulic control valve installing sections 82 and 83 are formed to have axes L1 and L2 inclined toward a direction perpendicular to the crankshaft axis C1 and are formed to vertically overlap one another, the intake- and the exhaust-side hydraulic control valves 48 and 49 being respectively attached thereto.

As thus described, in the engine 15, the mount installing section 66 is positioned below the actuator cover section 64 and is offset toward one side with respect to the cylinder axis C2; and the intake- and the exhaust-side hydraulic control valves 48 and 49 are disposed laterally of the mount installing section 66 with axes L1 and L2 inclined toward the direction perpendicular to the crankshaft axis C1, the intake- and the exhaust-side hydraulic control valves overlapping one another. Therefore, the mount installing section 66 and the two valves, the intake- and the exhaust-side hydraulic control valves 48 and 49, are disposed in intimate contact with the actuator cover section 64 to expand the space below the intake- and the exhaust-side hydraulic control valves 48 and 49.

Consequently, the engine 15 permits the two pulleys, i.e. the idler pulley 81 and the tensioner pulley 80, to be positioned in the space below the intake- and the exhaust-side hydraulic control valves 48 and 49, so that a plurality of accessories, i.e. the water pump 69, the air conditioning compressor 70, the power steering oil pump 71, and the alternator 72, which are positioned on the opposite sides of the chain case 50, can be driven by the single belt 79.

Also, the engine 15 permits the tensioner pulley 80, which is at a lower position in the cylinder axis direction C2, to be positioned adjacent to the crankshaft pulley 73 toward the loosening side of the belt 79 with respect to the crankshaft pulley 73; the alternator 72 and the air conditioning compressor 70, which are heavy among the plural accessories 69-72, can be positioned at a lower position and laterally of the crankshaft pulley 73 to lower the center of gravity of the engine.

Thereby, the engine 15 reduces its exciting force produced about the crankshaft 31 to reduce the force transmitted to the engine mount. Accordingly, the engine 15 effectively restrains the movement of the upper parts of the engine to prevent contact of the engine hood 11 with the components (e.g. the cylinder head cover 24 in FIG. 7) disposed in the upper part of the engine.

By the above-mentioned structure, the engine 15 permits the mount installing section 66 and the intake- and the exhaust-side hydraulic control valves 48 and 49 to be positioned in the space surrounded by the actuator cover section 64, the crankshaft pulley 73, and the accessories 69-72 without limiting the installing position of the accessories 69-72.

As shown in FIGS. 1 and 2, in the engine 15, the intake- and the exhaust-side hydraulic control valve installing sections 82 and 83 are formed to protrude on the exhaust side of the flat plate section 51 below the actuator cover section 64 of the chain case 50 with axes L1 and L2 inclined toward the direction perpendicular to the crankshaft axis C1, the intake- and the exhaust-side hydraulic control valve installing sections overlapping one another. The intake- and the exhaust-side hydraulic control valve installing sections 82 and 83 are inclined upwardly such that axes L1 and L2 become more distant from the crankshaft axis C1 when departing from the cylinder axis C2 in the direction of the exhaust-side attaching flange 55; the sections 82 and 83 are disposed on the flat plate section 51 of the chain case 50 opposing to the cylinder head 23; the intake- and the exhaust-side hydraulic control valves 48 and 49 are attached to the sections 82 and 83.

Referring to FIG. 5, the chain case 50 includes a recess section 84 which is inward of the flat plate section 51, where the actuator cover section 64 is formed and which opens upwardly toward the cylinder head 23, and a recess section 85 which is inward of the flat plate section 51, where the mount installing section 66 is formed, and which opens toward the cylinder head 23. In the chain case 50, intake- and exhaust-side case boss sections 86 and 87 are formed inward of the flat plate section 51, where the intake- and the exhaust-side hydraulic control valve installing sections 82 and 83 are formed, with the sections 86, 87 vertically overlapping, the intake-side case boss section 86 being adjacent to the cylinder axis C2, and the exhaust-side case boss section 87 being adjacent to the exhaust-side attaching flange 55.

The intake-side case boss section 86 includes: an intake-side operating oil introducing hole 88 for introducing the operating oil from the cylinder head 23; and an intake-side advance operating oil discharge hole 89 and an intake-side retard operating oil discharge hole 90 which discharge to the cylinder head 23 the intake-side operating oil for advance or retard divided by the intake-side hydraulic control valve 48. The exhaust-side case boss section 87 includes: an exhaust-side operating oil introducing hole 91 for introducing the operating oil from the cylinder head 23; and an exhaust-side advance operating oil discharge hole 92 and an exhaust-side retard operating oil discharge hole 93 which open to discharge to the cylinder head 23 the intake-side operating oil for advance or retard divided by the exhaust-side hydraulic control valve 49.

Referring to FIG. 3, intake- and exhaust-side head boss sections 94 and 95 are formed on an edge surface of the cylinder head 23 opposing to the intake- and the exhaust-side case boss sections 86 and 87, to which the intake- and the exhaust-side case boss sections 86 and 87 are respectively joined, with the sections 94 and 95 overlapping vertically and being arranged in a direction departing from the cylinder axis C2.

The intake-side head boss section 94 includes: an intake-side operating oil passage 96 on the cylinder head 23 for supplying the operating oil to the intake-side operating oil introducing hole 88 in the intake-side case boss section 86; and an intake-side advance operating oil passage 97 and an intake-side retard operating oil passage 98 which open to be supplied with the intake-side advance/retard operating oil discharged from the intake-side advance operating oil discharge hole 89 and the intake-side retard operating oil discharge hole 90 respectively. The intake-side advance operating oil passage 97 and the retard operating oil passage 98 extend toward the intake camshaft 32 diagonally upward of the cylinder head 23 beyond the cylinder axis C2, and have other ends connected to the intake-side actuator 46 for supplying the intake-side advance operating oil and the retard operating oil respectively.

The exhaust side head boss section 95 includes: an exhaust-side operating oil passage 99 on the cylinder head 23 for supplying the operating oil to the exhaust-side operating oil introducing hole 91 in the exhaust-side case boss section 86; and an exhaust-side advance operating oil passage 100 and an exhaust-side retard operating oil passage 101 which open to be supplied with the exhaust-side advance operating oil and the retard operating oil discharged from the exhaust-side advance operating oil discharge hole 92 and the retard operating oil discharge hole 93 respectively. The exhaust-side advance operating oil passage 100 and the retard operating oil passage 101 extend toward the exhaust camshaft 33 over the cylinder head 23 and communicating with the exhaust-side actuator 47 for supplying the exhaust-side advance operating oil and the retard operating oil respectively.

As thus described, the engine 15 includes, as shown in FIG. 1, the intake- and the exhaust-side hydraulic control valves 48 and 49 disposed on the chain case 50 opposing to the cylinder head 23 with axes L1 and L2 being inclined upwardly to be away from the crankshaft axis C1 when moving in a direction away from the cylinder axis C2 towards the exhaust-side attaching flange 55. This expands the space below the hydraulic control valves 48 and 49 to prevent the problem of complication in placing the belt 79 for driving the accessories 69-72.

Also, the engine 15 includes, as shown in FIGS. 3, the intake- and the exhaust-side operating oil passages 96 and 99 for supplying the operating oil to the intake -and the exhaust-side hydraulic control valves 48 and 49. The engine 15 also includes the intake-side advance operating oil passage 97 and the retard operating oil passage 98 which communicate between the intake-side hydraulic control valve 48 and the actuator 46, and the exhaust-side advance operating oil passage 100 and the retard operating oil passage 101 which communicate between the exhaust-side hydraulic control valve 49 and the actuator 47. Such operating oil passages 97, 98, 100, 101 can be positioned toward the cylinder head 23, thereby simplifying the structure of the operating oil passage for the hydraulic control valves of the variable valve timing mechanism 45.

Further, the engine 15 includes, as shown in FIG. 1, the exhaust-side hydraulic control valve 49 which is the upper (in the direction of the cylinder axis C2) one of the valves 48 and 49 attached to the intake- and the exhaust-side hydraulic control valve installing sections 82 and 83. The exhaust-side hydraulic control valve 49 is offset outwardly in the direction of axes L1, L2 (toward the exhaust side) with respect to the lower intake-side hydraulic control valve 48. The engine 15 also includes, as shown in FIG. 3, the intake-side advance operating oil passage 97 and the retard operating oil passage 98, which communicate between the lower intake-side hydraulic control valve 48 and the intake-side actuator 46, disposed sideward of the upper exhaust-side hydraulic control valve 49. This prevents interference of the exhaust-side advance operating oil passage 100 and the retard operating oil passage 101, which communicate between the lower exhaust-side hydraulic control valve 49 and the exhaust-side actuator 47, with the upper intake-side hydraulic control valve 48, thereby simplifying the structure of the operating oil passage for the variable valve timing 45.

INDUSTRIAL APPLICABILITY

The variable valve timing mechanism-equipped engine according to the present invention expands the space below the intake- and the exhaust-side hydraulic control valves. In this space, the two pulleys, i.e. the idler pulley and the tensioner pulley, can be positioned, so that more than one accessory, which are positioned on the transverse opposite sides of the chain case, can be driven by the single belt. The present invention can be applied to an engine having a plurality of accessories on transverse opposite sides of the chain case.

EXPLANATION OF REFERENCE NUMERALS

1—vehicle;
14—engine space;
15 engine (variable valve timing mechanism-equipped engine);
16—transmission;
22—cylinder block;
23—cylinder head;
24—cylinder head cover;
28—exhaust manifold;
30—intake manifold;
31—crankshaft;
32—intake camshaft;
33—exhaust camshaft;
37—intake camshaft sprocket;
38—exhaust camshaft sprocket;
39—timing chain;
45—variable valve timing mechanism;
46—intake-side actuator;
47—exhaust-side actuator;
48—intake-side hydraulic control valve;
49—exhaust-side hydraulic control valve;
50—chain case;
64—actuator cover section;
66—mount installing section;
69—water pump;
70—air conditioning compressor;
71—power steering oil pump;
72—alternator;
73—crankshaft pulley;
79—belt;
82—intake-side hydraulic control valve installing section;
83—exhaust-side hydraulic control valve installing section.

What is claimed is:

1. A variable valve timing mechanism-equipped engine having a crankshaft rotatably supported in a cylinder block of the engine, a pair of intake and exhaust camshafts rotatably supported on a cylinder head mounted on the upperside of the cylinder block, a timing chain entrained around a crankshaft sprocket and intake and exhaust camshaft sprockets, the crankshaft sprocket being attached to the crankshaft, the intake and the exhaust camshaft sprockets being attached to the intake and the exhaust camshafts, intake-side and exhaust-side actuators attached to the intake and the exhaust camshafts for changing the rotational phase of the intake and the exhaust camshafts with respect to the crankshaft, the intake-side and the exhaust-side actuators being operated by the operating oil supplied from intake-side and exhaust-side hydraulic control valves respectively, a chain case, when viewing the engine from an axial direction of the crankshaft, having transverse opposite ends joined to the cylinder block and the cylinder head and having an upper end joined to the cylinder head cover for covering the timing chain, an actuator cover section formed in the chain case to be expanded in the axial direction of the crankshaft along a mating surface with the cylinder head cover for covering the intake-side and the exhaust-side actuators, a mount installing section expanded in the axial direction of the crankshaft to be disposed below the actuator cover section for connecting an engine mount, and accessories arranged on transverse opposite sides of the chain case to overlap along a cylinder axis direction, the accessories being driven through a belt on a crankshaft pulley attached to the crankshaft, characterized in that the mount installing section is positioned below the actuator cover section and is offset toward one side with respect to the cylinder axis, and the intake-side and the exhaust-side hydraulic control valves are disposed sideward of the mount installing section with axes inclined toward a direction perpendicular to the crankshaft axis, the intake-side and the exhaust-side hydraulic control valves overlapping one another.

2. The variable valve timing mechanism-equipped engine according to claim 1, wherein the intake-side and the exhaust-side hydraulic control valves are inclined such that their axes become more distant from the crankshaft axis when departing from the cylinder axis, and are disposed on the chain case opposing to the cylinder head.

3. The variable valve timing mechanism-equipped engine according to claim 2, wherein the hydraulic control valve which is an upper one of the intake-side and the exhaust-side hydraulic control valves in the direction of the cylinder axis C2, is offset outwardly in the direction of axes of the hydraulic control valves with respect to a lower one of the intake-side and the exhaust-side hydraulic control valves, and wherein an operating oil passage, communicating between the lower one of the hydraulic control valves and the intake-side actuator, is disposed sideward of the upper one of the intake-side and the exhaust-side hydraulic control valve.

* * * * *